United States Patent [19]

Priebe

[11] 4,213,318

[45] Jul. 22, 1980

[54] APPARATUS FOR FITTING AN EXTRUSION DIE HOLDER ONTO THE PRESS STEM OF AN INDIRECT METAL EXTRUSION PRESS

[75] Inventor: Fritz Priebe, Duisburg, Fed. Rep. of Germany

[73] Assignee: Schloemann-Siemag Aktiengesellschaft, Dusseldorf, Fed. Rep. of Germany

[21] Appl. No.: 973,535

[22] Filed: Dec. 26, 1978

[30] Foreign Application Priority Data

Dec. 24, 1977 [DE] Fed. Rep. of Germany ..... 2757964

[51] Int. Cl.[2] ..... B21C 25/02; B21C 33/00

[52] U.S. Cl. ..... 72/21; 72/253 A; 72/253 R; 72/261; 72/263; 414/433; 414/757

[58] Field of Search ..... 72/253, 257, 261, 263, 72/270, 273, 21, 25, 26; 414/757, 433

[56] References Cited

U.S. PATENT DOCUMENTS

| | | | |
|---|---|---|---|
| 1,608,119 | 11/1926 | Perchard | 414/757 |
| 2,372,706 | 4/1945 | Blair | 72/270 |
| 2,963,151 | 12/1960 | Kent et al. | 72/263 |
| 3,314,267 | 4/1967 | Kent et al. | 72/263 |
| 3,362,205 | 1/1968 | Edgecombe | 72/253 R |
| 3,465,565 | 9/1969 | Groos | 72/263 |
| 3,530,702 | 9/1970 | De Ridder | 72/273 |
| 3,599,467 | 8/1971 | Valks | 72/263 |
| 4,154,081 | 5/1979 | Boshold | 72/263 |

*Primary Examiner*—Leon Gilden
*Assistant Examiner*—D. M. Gurley
*Attorney, Agent, or Firm*—Holman & Stern

[57] ABSTRACT

An extrusion die mounted in a die holder is fitted onto the end of the press stem of an extrusion press by apparatus which has a swing arm which receives a die holder in a first position, then pivots to a second position where the die holder is aligned with the extrusion press stem, rotates the die holder so that it is correctly oriented relative to the press stem and then pushes the die holder axially onto the press stem.

10 Claims, 7 Drawing Figures

APPARATUS FOR FITTING AN EXTRUSION DIE HOLDER ONTO THE PRESS STEM OF AN INDIRECT METAL EXTRUSION PRESS

FIELD OF THE INVENTION

The invention relates to apparatus for fitting an extrusion die holder onto the hollow press stem of an indirect metal extrusion press, in particular for multiple core pressing, by means of pivotal, rotary and axial movements.

BACKGROUND OF THE INVENTION

In indirect extrusion, the counter platen of the press is generally provided with a stationary hollow press stem which supports at its free front end a die which is arranged in a disc, the so-called die holder. A sealing plate is provided between the billet container and the moving crosshead of the press and seals the bore of the billet container from the moving crosshead. During extrusion, the billet container, together with the billet located in its bore is pushed over the stationary hollow stem, whereby the press charge is pressed through the die and the hollow stem and out through a larger opening in the counter platen.

Depending on the press programme, the die may be provided with, for example, two bores for two-core wire extrusion. In order to guide the two wire cores in the hollow stem without them touching each other, two guide tubes are provided in the hollow stem. The die holder together with the die fixed therein must be pushed onto the hollow stem in such a manner that the die apertures in the die line up exactly with the guide tubes located in the hollow stem.

The dies must be removed and cleaned at intervals, and then must be lifted again to the centre of the hollow stem, rotated into the aligning position and pushed onto the stem.

SUMMARY OF THE INVENTION

It is an object of the invention to permit these individual working steps, each of which is known per se, to be performed in a single apparatus having the least space requirement and the simplest construction.

In the invention, a cylindrical die holder is receivable with its axis parallel to the axis of the hollow press stem, in a combined pivotal, rotary and push-on apparatus which comprises a swing arm which is rotatably mounted, perpendicularly in respect of the press, in a stationary frame, the swing arm having two cylindrical rollers with their axes in parallel which are mounted therein parallel to the press axis and which are drivable in the same direction of rotation, and a push-on device provided in the swing arm and co-operating with the swing arm parallel to the press axis, wherein in the receiving position of the swing arm the die holder is supported partly on the front end of a portion of the swing arm formed like a fork at an acute angle, and partly on one of the rollers, and after the swing arm has been swung upwards towards the centre of the press stem is supportable by itself on the two rollers and the rotation of the rollers is disconnectable by means of a contact co-operating with the die holder and the die holder is movable against the hollow stem by means of the push-on device.

Three different operating sequences are united here in a single combined apparatus and performable in the smallest space, viz. upward rotation of the die holder from the receiving position at the magazine to the centre of the hollow press stem; rotation of the holder about its axis to a particular orientation, for example for a die for twin extrusion, in which case the rotation process is disconnectable by means of a contact after the correct orientation has been detected; and axial push-on movement of the die holder against the hollow stem.

In a further development of the invention a plate of the swing arm comprises in the direction of the feed of the die holder, an acute angle formed like a fork in its upper region, and is of arcuate construction at its outside, the peripheral length of the arc corresponding to the angle of rotation of the swing arm. During the pivotal movement, the next following die holder is thus prevented from leaving the magazine by means of the arcuate portion of the swing arm.

The swing arm which is rotatably mounted in a stationary frame is pivotal in an advantageous manner from a receiving position to a delivery position by means of a hydraulic piston-cylinder device which is stationarily fixed at one end and joined to the swing arm at the other end.

For rotating the die holder in the delivery position, the rollers may comprise at one end toothed crowns which are in meshing engagement with a rotating device arranged in the swing arm, the toothed crowns being provided at the end of the rollers remote from the free front end of the hollow stem. In this case the rotating device comprises a drive brake motor which is arranged in the swing arm and the take-off of which is in engagement with the toothed crowns of the rollers by way of a gear wheel. Absolutely synchronous running of the rollers is given thereby.

In a further embodiment, a switching groove having the width of the axial displacement of the die holder is provided at the periphery of the die holder; it extends tangentially at an acute angle inwardly and is limited by a terminal abutment, the groove cooperating with a stationarily mounted switching pin which scans the peripheral surface of the die holder for the purpose of switching off the rotating device in the correct orientation of the die holder relatively to the hollow stem. An accurate position of the die holder relatively to the hollow stem is obtainable by means of this switching pin which actuates a contact upon reaching the switching groove in consequence of the die holder rotating under it.

In an advantageous further development the swing arm is suspended in the stationary frame from a pin which is movable axially and parallel to the press axis, the pin being guided in bearings of the stationary frame and being connected at one front end to the piston of a hydraulic cylinder fixed in the stationary frame. In this way the swing arm may be swung about the axis of the pin and additionally it may also be displaced parallel to the press axis by means of the pin, whereby the die holder is pushed towards the hollow stem. In this case the die holder is supported, when pushed to the hollow stem, on its back face in the lower region by toothed crown segments of the rollers and in the upper region by an abutment fixed on the swing arm. By means of this three-point abutment of the die holder a secure guidance of the latter to the hollow stem is ensured.

In order that the entire mass of the swing arm need not be displaced parallel to the press axis, the die holder alone may be displaced parallel to the shafts of the rollers and sliding on them, with the swing arm axially fixed, by a piston of a hydraulic cylinder arranged on the stationary frame.

However, in order to prevent the periphery of the die holder from having to slide on the rollers, the die holder and the rollers may be displaced together, with the swing arm being axially fixed, by the piston of a hydraulic cylinder arranged on the stationary frame. In this case the rollers are constructed to be axially displaceable in their bearing in the swing arm. In order that during the displacement process the rollers remain always in engagement with the gear wheel of the rotating device by means of their toothed crowns, the width of the rotating device is adjusted to the displacement path of the die holder or the mutually meshing toothed crown widths must be dimensioned correspondingly.

IN THE DRAWINGS

Figure 4B:
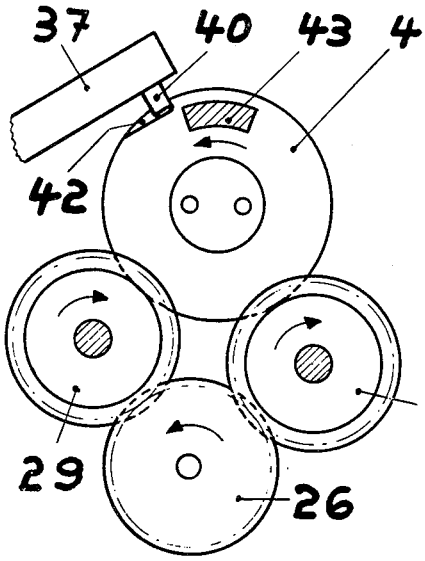
Figure 4A:
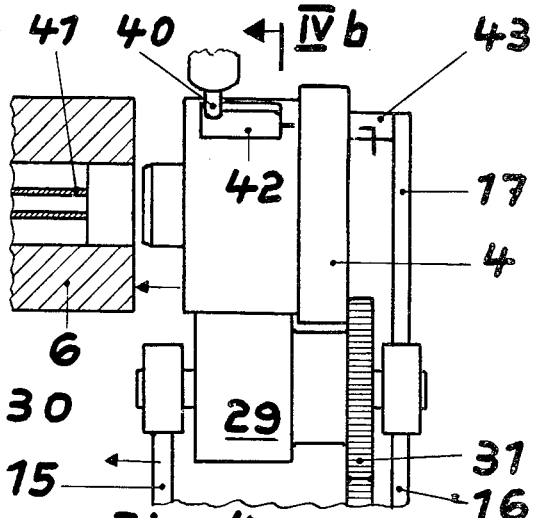
Figure 5:
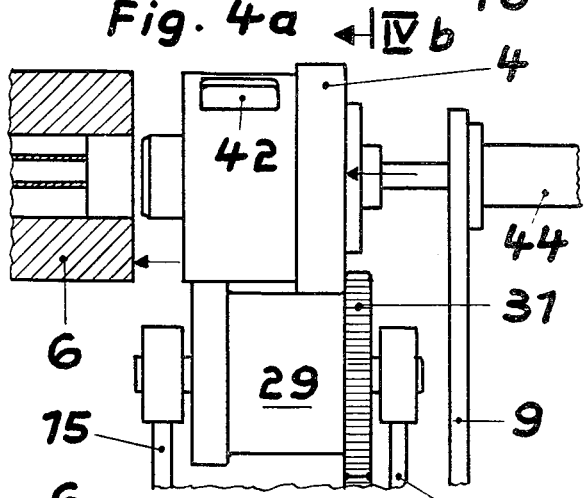
Figure 6:
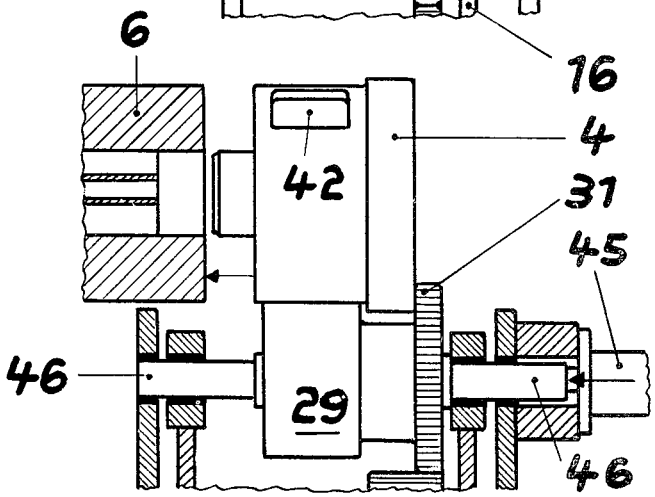

FIG. 4*a* is a partial side view of the device swung towards the hollow plunger prior to the push-on process of the die holder with axial displacement of the entire swing arm in the direction of the arrow;

FIG. 4*b* is a diagrammatic view of the front end of part of the device, taken on lines IV*b*—IV*b* of FIG. 4*a*;

FIG. 5 is a partial side view, corresponding to FIG. 4*a*, but of a modified device; and FIG. 6 is a partial side view also corresponding to FIG. 4*a*, but of another modified device.

Figure 1:
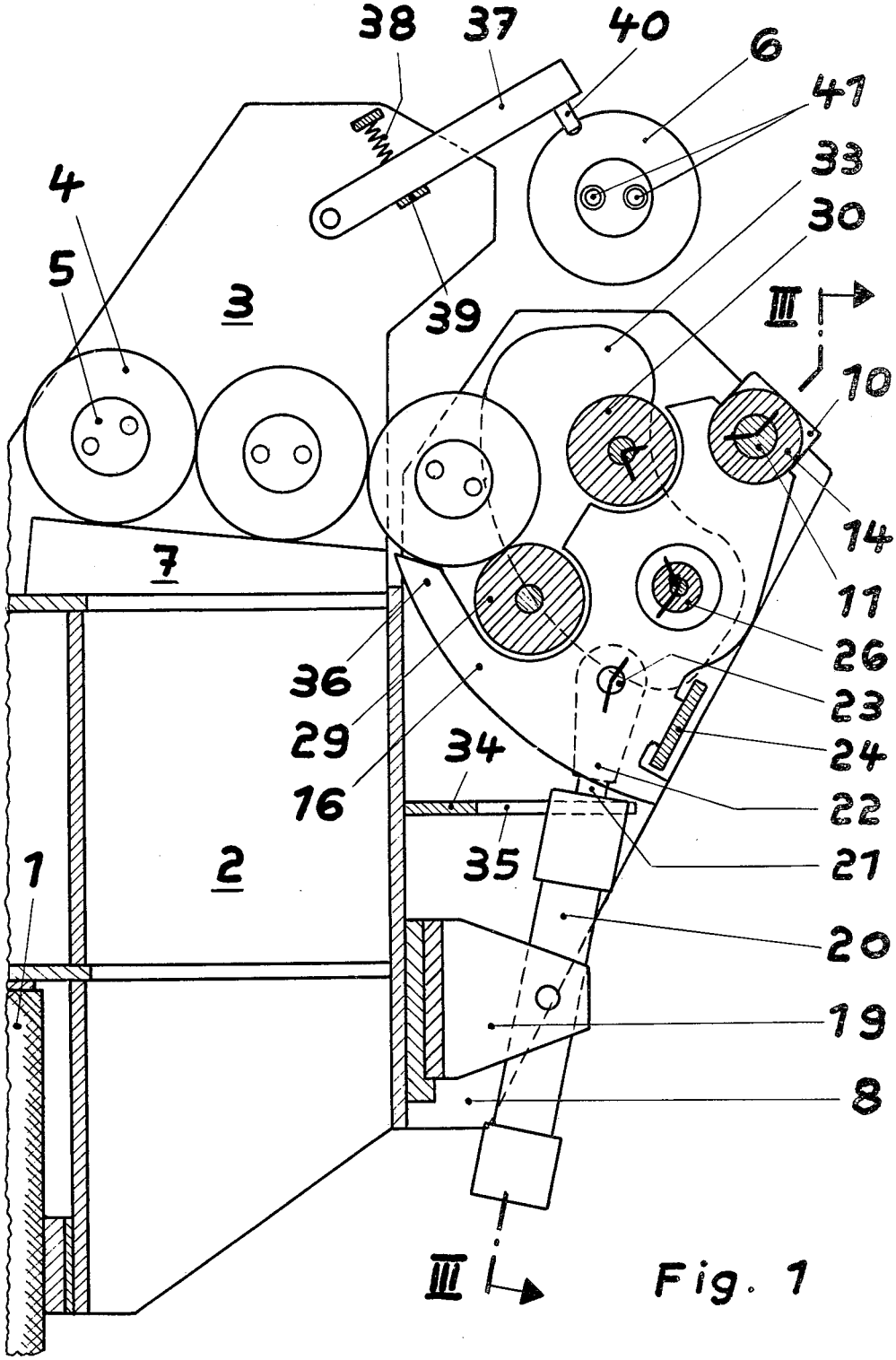
FIG. 1 is a sectional view on the line I—I of FIG. 3 of a device embodying the invention for fitting an extrusion die holder onto the hollow stem of an extrusion press.

A stationary box-shaped frame 2 consisting of various plates welded together, is attached to a base 1 (FIG. 1).

On its upper surface, this frame 2 contains a magazine 3 for supplying die holders 4 with cleaned dies 5 provided in them, to a hollow stem 6 which has been moved laterally away from the press axis of an indirect metal extrusion press. In this case the hollow stem 6 may be displaceable perpendicularly to the press axis on a carriage guide provided on the counter platen (not illustrated) of the press. Initially the die holders 4 rest in this case on a plane 7 which is slightly inclined in the direction of the press axis.

Figure 3:
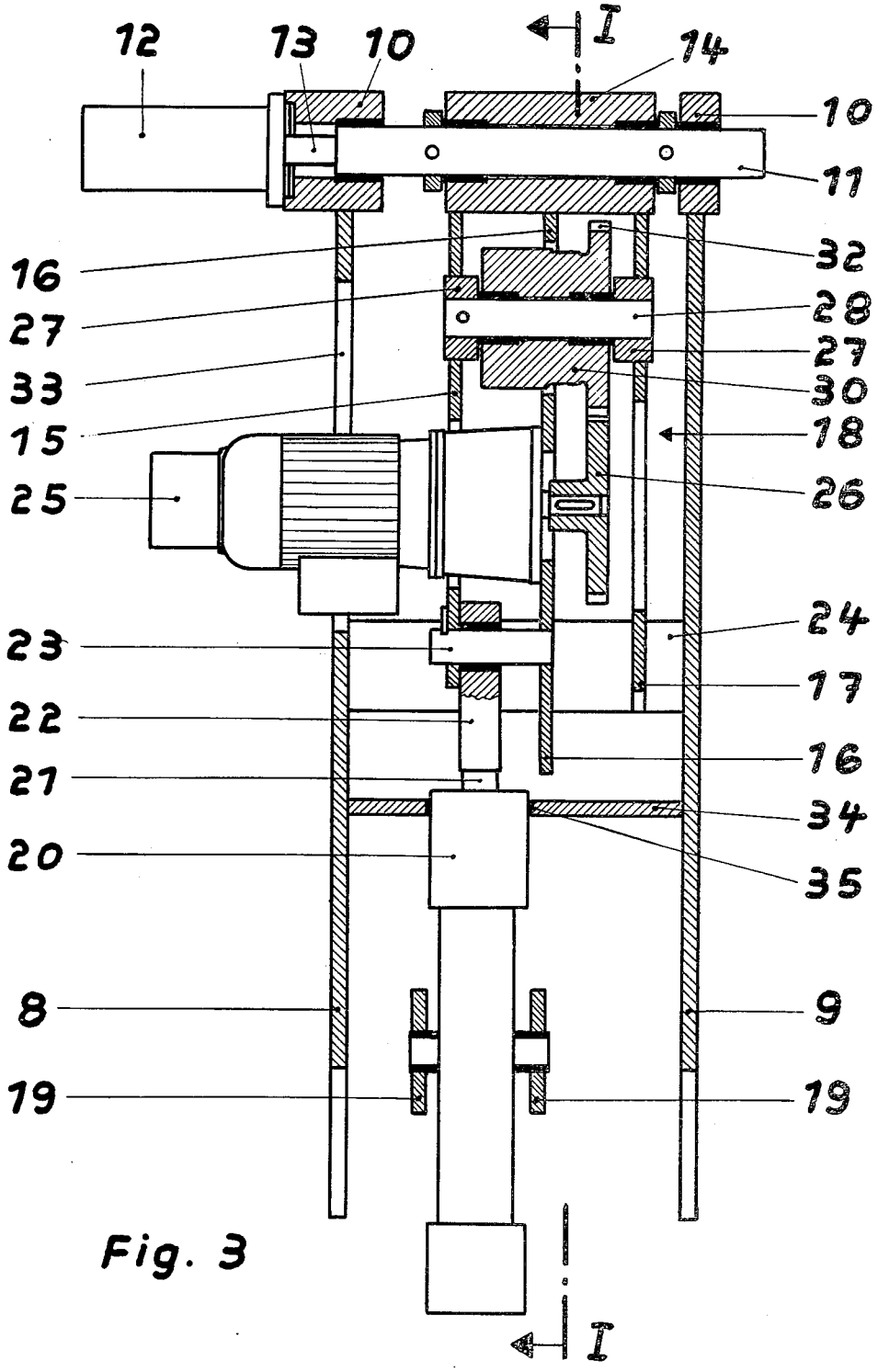
FIG. 3 is a sectional side view of the device on the lines III—III of FIG. 1.

Perpendicularly to the extrusion direction at a spacing from each other, two plates 8 and 9 are fixed to the stationary frame 2 (FIG. 3). In their upper region a pin 11 is provided which is axially displaceable parallel to the press axis in bearings 10. The one bearing 10 is attached to a hydraulic cylinder 12, the piston 13 of which is connected to the pin 11.

A hub 14 is axially non-displaceably, but rotatably mounted on these pins 11 with a spacing between the bearings 10. This hub 14 has attached thereto three differently shaped parallel plates 15, 16 and 17 the planes of which lie in the direction of rotation of the hub 14. These plates 15, 16 and 17 form a so-called swing arm 18.

Figure 2:
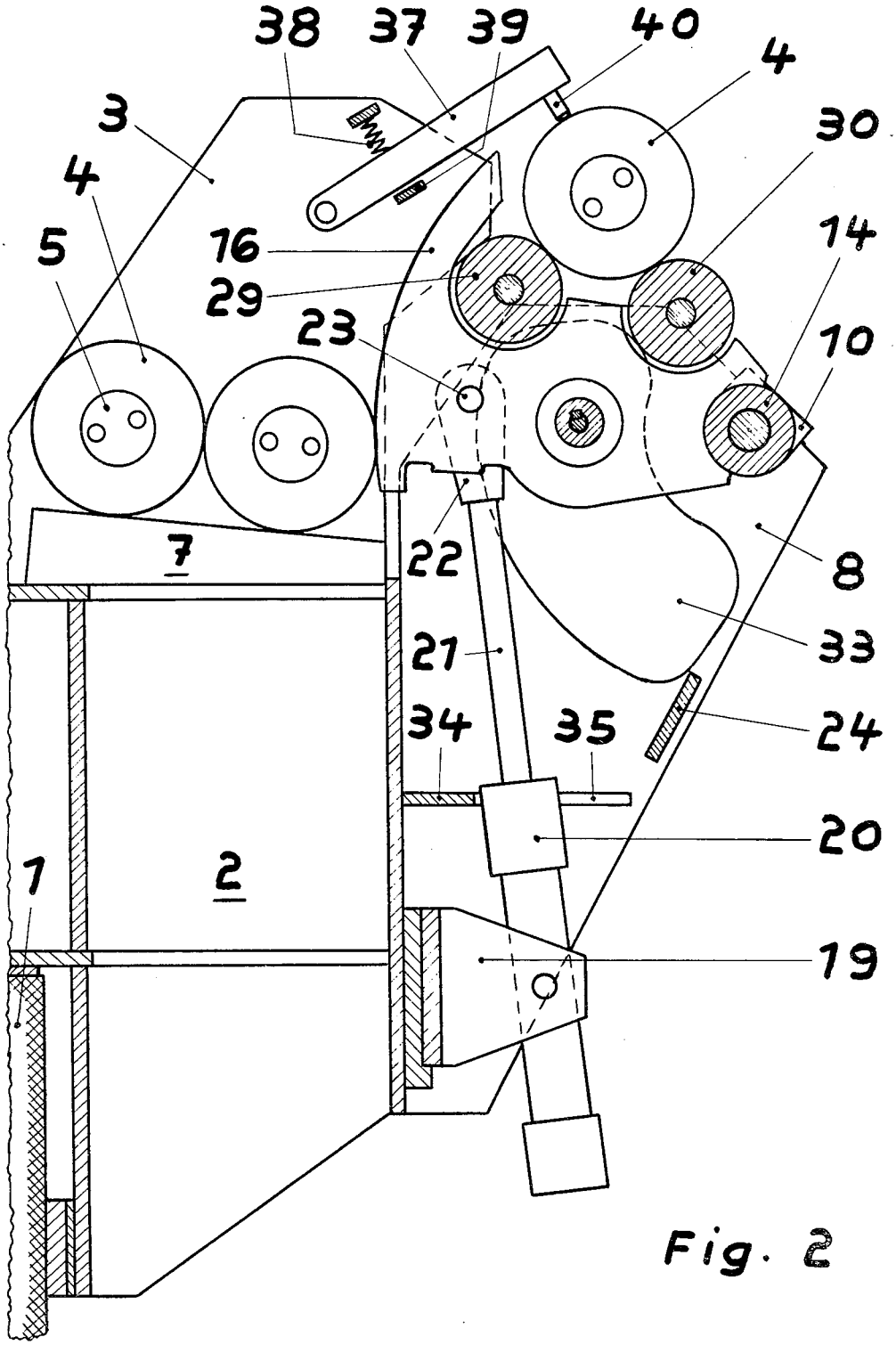
FIG. 2 is a view similar to FIG. 1, but with the device swung towards the hollow stem in the delivery position.

This swing arm 18 is swung around the pin 11 by means of a further hydraulic cylinder 20 which is rotatably mounted in a stationary bearing block 19 fixed to the frame 2 and which operates as a swing cylinder. The piston rod 21 thereof is pivotally connected by means of an eye 22 to a pin 23 fixed between the plates 15 and 16 of the swing arm 18 and presses the swing arm 18 upwardly about the pin 11 provided as a stationary pivot point, into a so-called delivery position (FIG. 2). In the lower position of the swing arm 18 the latter abuts an abutment 24 fixed to the stationary plates 8, 9.

A drive brake motor 25 having its axis parallel to the hub 14 is arranged on the middle plate 16 (FIG. 3) of the swing arm 18. A driver gear wheel 26 is non-rotatably mounted on its take-off shaft. Furthermore, bushes 27 are provided in the two outer plates 15 and 17 of the swing arm 18, and a shaft 28 is secured in each of them. Rollers 29 and 30 are mounted on these shafts 28. At one end face, each of the rollers 29 and 30 supports a toothed crown 31 and 32, respectively, which are in engagement with the gear wheel 26 of the drive brake motor 25.

In order that the swing arm 18 together with the drive brake motor 25 may be swung from the lower to the upper position, a kidney-shaped recess 33 is provided in the stationary plate 8 (FIGS. 1, 2 and 3). Furthermore, a cross plate 34 is arranged between the plates 8 and 9 of the stationary frame 2 in the upper region of the hydraulic swing cylinder 20 and comprises a slot 35 with slide edges having the length of the swing range for the cylinder casing of the hydraulic cylinder 20.

The middle plate 16 of the swing arm 18 is of circular construction on the side facing the magazine 3 for the die holders 4 and its peripheral length corresponds to the angle of rotation of the swing arm 18 (FIGS. 1 and 2). The plate 16 has its upper, outer edge cut away inwardly at an acute angle. In the receiving position of the swing arm 18, the point 36 of the plate 16 lies exactly at or slightly below the level of the inclined plane 7 of the magazine 3. The point 36 of the plate 16 is of fork-like construction owing to an additional small plate (not shown) arranged parallel to plate 16. Semi-circular recesses for the rollers 29 and 30 are provided in the upper edge of the plate 16.

Furthermore, a lever 37 is pivotally connected to the stationary frame 2 above the magazine 3 and is urged against an abutment 39, by the pressure of a spring 38 (FIGS. 1 and 2). At its free end, the lever 37 supports a switching pin 40 which scans the periphery of the die holder 4 after it has been upwardly rotated into the delivery position.

The operation of the device during two-core pressing will now be described.

A die holder 4 rolls off the inclined plane 7 onto the swing arm 18. With arm 18 in the receiving position, the die holder rests on the acutely angled fork-shaped portion of the plate 16 and on the roller 29 facing the magazine 3 (FIG. 1). In FIG. 1, two guide tubes 41 can be seen in the hollow stem 6 and these tubes receive the extruded product. As the arm 18 is turned by the hydraulic cylinder 20, the die holder 4 rolls to the right (FIGS. 1 and 2) and lies then on the two rollers 29 and 30. As the arm turns, the arcuate edge of the plate 16 ensures that the next-following die holder 4 in the magazine 3 cannot roll into the swing arm. Moreover as the die holder 4 is raised, it contacts the pin 40 and lifts the lever 37.

When the swing arm 18 has reached its uppermost position in front of the hollow stem 6, the drive brake motor 25 rotates the die holder 4 via rollers 29 and 30. The periphery of the die holder is provided with a switching groove 42 (FIGS. 4, 5 and 6) which extends tangentially inwardly at an acute angle and which is limited by a terminal abutment. As the die holder 4 rotates, the switching pin 40 drops into the groove, and the lever 37 comes into contact with the abutment 39, and switches the drive brake motor 25 off. The position of the groove relative to the die apertures is set so that the apertures register with the tubes 41 when the motor 25 is switched off (FIGS. 4*a* and 4*b*).

The hydraulic cylinder 12 is next energised, and the piston 13 pulls the pin 11 together with the entire swing arm 18 hanging therefrom, to the left (FIG. 3 and FIG. 4*a*) in the direction of the hollow stem 6, whereby the die holder 4 is pushed into the hollow stem 6; the die holder 4 is pushed by the two toothed crown segments at the bottom and by a support 43 at the top, which is located on the plate 17 of the swing arm 18. After the die holder 4 is located on the hollow stem, the swing arm 18 is moved downwards by means of the hydraulic cylinder 20, and the roller 30 moves away from the die holder 4. After the downward rotation the swing arm 18 is returned to the starting position effected by the hydraulic cylinder 12 (FIG. 3), whereupon a new die holder 4 can roll out of the magazine 3 into the swing arm 18.

To avoid having to move the entire mass of the swing arm 18 when pushing the die holder on to the press stem, the die holder 4 can be displaced directly in the direction of the arrow in FIG. 5, sliding axially on the rollers 29 and 30, by means of a hydraulic cylinder 44 located on the frame 9.

Alternatively, and to avoid sliding of the die holder 4 on the rollers 29 and 30, the rollers 29 and 30 can be displaced together with the die holder by means of a hydraulic cylinder 45 located on the stationary frame plate 9. In this case the shafts 46 of the rollers 29 and 30 slide in bearings of the swing arm 18, the toothed crown segments of the rollers 29 and 30 abutting the die holder 4 and pushing it forward in the direction of the arrow in FIG. 6.

I claim:

1. Apparatus for fitting an extrusion die holder onto the press stem of an indirect extrusion press, the apparatus comprising:

a stationary frame;

a swing arm mounted on the frame and having an upper edge;

two cylindrical rollers mounted for rotation at the upper edge of the swing arm;

feed means for feeding die holders to the upper edge of the swing arm;

means for pivoting the swing arm about an axis between a first position where the feed means feeds a die holder onto the arm so that the holder is supported on said upper edge and on one of the two rollers, and a second position where the die holder is supported on both rollers;

drive means for driving both rollers in the same direction of rotation, when the swing arm is in said second position, to rotate the die holder;

sensing means following the surface of the die holder as the holder rotates, and arranged to stop said drive means when the holder reaches a predetermined orientation; and a push-on device for pushing the oriented holder axially in a direction parallel to the pivot axis of the swing arm.

2. Apparatus as claimed in claim 1, wherein the swing arm has a plate with an arcuate edge which faces said feed means and has a length corresponding to the pivoting movement of the swing arm, the arcuate edge joining said upper edge at an acute angle of fork-like configuration.

3. Apparatus as claimed in claim 1, wherein the means for pivoting the swing arm comprises a hydraulic piston/cylinder unit which is mounted at one end on the stationary frame and at the other end on the swing arm.

4. Apparatus as claimed in claim 1, wherein the drive means for driving the rollers is a rotating toothed device mounted on the swing arm, and the rollers include toothed crowns which are in meshing engagement with the rotating device, so as to be driven thereby, the toothed crowns being provided at the rear end of the rollers relative to the direction of movement created by the push-on device.

5. Apparatus as claimed in claim 4, wherein the rotating device is a drive brake motor arranged on the swing arm.

6. Apparatus as claimed in claim 1, wherein each die holder to be fitted by the apparatus has a groove which extends axially of the holder over a distance corresponding to the length of axial movement produced by the push-on device, and the sensing means comprises a pivotable switching pin which follows the peripheral surface of the die holder and switches off the drive means when the pin drops into the groove.

7. Apparatus as claimed in claim 4, wherein the swing arm is pivoted in the stationary frame on a pin, and the push-on device comprises a hydraulic piston/cylinder unit of which the cylinder is fixed to the stationary frame and the piston is fixed to the pin, so that on actuation of the piston/cylinder unit, the piston moves to displace the pin and the swing arm axially relative to the stationary frame.

8. Apparatus as claimed in claim 7, wherein a support for the die holder is provided in the upper region of the swing arm, and when the push-on device is actuated, the die holder is pushed by the toothed crowns of the rollers and by said support.

9. Apparatus as claimed in claim 1, wherein the push-on device comprises a hydraulic piston/cylinder unit mounted on the stationary frame and arranged to act directly on a die holder to push the holder axially relative to the two rollers.

10. Apparatus as claimed in claim 1, wherein the push-on device comprises a hydraulic piston/cylinder unit arranged on the stationary frame and connected to axes of the two rollers so as to move the two rollers axially together with a die holder supported on both rollers.

* * * * *